US006953622B2

(12) United States Patent
Tsai et al.

(10) Patent No.: US 6,953,622 B2
(45) Date of Patent: Oct. 11, 2005

(54) BIODEGRADABLE BICOMPONENT FIBERS WITH IMPROVED THERMAL-DIMENSIONAL STABILITY

(75) Inventors: Fu-Jya Daniel Tsai, Appleton, WI (US); Brigitte C. Wertheim, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/331,197

(22) Filed: Dec. 27, 2002

(65) Prior Publication Data

US 2004/0126578 A1 Jul. 1, 2004

(51) Int. Cl.[7] ..... D01F 8/00
(52) U.S. Cl. ..... 428/373; 428/370; 428/374
(58) Field of Search ..... 428/370, 373, 428/374; 528/354

(56) References Cited

U.S. PATENT DOCUMENTS 5,698,322 A 12/1997 Tsai et al.
6,177,193 B1 1/2001 Tsai et al.
6,506,873 B1 * 1/2003 Ryan et al. ..... 528/354

FOREIGN PATENT DOCUMENTS

EP 0 905 292 A 3/1999
WO WO 98/50611 11/1998

* cited by examiner

*Primary Examiner*—N. Edwards
(74) *Attorney, Agent, or Firm*—Brinks Hofer Gilson & Lione; G. Peter Nichols

(57) ABSTRACT

A biodegradable hydrophilic binder fiber. These fibers may be produced by co-spinning an aliphatic polyester material in a side-by-side configuration with a polylactide polymer to obtain a fiber with improved material attributes. A multicarboxylic acid may be incorporated into either or both components of the fiber. The aliphatic polyester polymer may be selected from a polybutylene succinate polymer, a polybutylene succinate-co-adipate polymer, or a blend of these polymers. The biodegradable bicomponent fiber exhibits substantial biodegradable properties, yet has improved thermal stability and has significantly reduced shrinkage. The bicomponent fiber may be used in a disposable absorbent product intended for the absorption of fluids such as body fluids.

26 Claims, No Drawings

BIODEGRADABLE BICOMPONENT FIBERS WITH IMPROVED THERMAL-DIMENSIONAL STABILITY

FIELD OF THE INVENTION

The present invention relates to biodegradable bicomponent binder fibers. These fibers may be produced by co-spinning an aliphatic polyester material in a side-by-side configuration with a polylactide polymer to obtain a fiber with improved material attributes. A multicarboxylic acid may be incorporated into either or both components of the fiber. The aliphatic polyester polymer may be selected from a polybutylene succinate polymer, a polybutylene succinate-co-adipate polymer, and a blend of these polymers. The biodegradable bicomponent fiber exhibits substantial biodegradable properties, yet has improved thermal stability and has significantly reduced shrinkage. The bicomponent fiber may be used in a disposable absorbent product intended for the absorption of fluids such as body fluids.

BACKGROUND OF THE INVENTION

Disposable absorbent products currently find widespread use in many applications. For example, in the infant and child care areas, diapers and training pants have generally replaced reusable cloth absorbent articles. Other typical disposable absorbent products include feminine care products such as sanitary napkins or tampons, adult incontinence products, and health care products such as surgical drapes or wound dressings. A typical disposable absorbent product generally comprises a composite structure including a topsheet, a backsheet, and an absorbent structure between the topsheet and backsheet. These products usually include some type of fastening system for fitting the product onto the wearer.

Disposable absorbent products are typically subjected to one or more liquid insults, such as of water, urine, menses, or blood, during use. As such, materials of the disposable absorbent products are typically made of liquid-insoluble materials, such as polypropylene films. The films exhibit a sufficient strength and handling capability so that the disposable absorbent product retains its integrity during use by a wearer.

Although current disposable baby diapers and other disposable absorbent products have been generally accepted by the public, these products still have need of improvement in specific areas. For example, many disposable absorbent products may be difficult to dispose of through a toilet or pipes connecting a toilet to the sewer system.

Environmental wellness of disposable absorbent products is becoming an ever increasing concern throughout the world. As landfills continue to fill up, there has been an increased demand for material source reduction in disposable products, the incorporation of more recyclable and/or degradable components in disposable products, and the design of products that may be disposed of by means other than by incorporation into solid waste disposal facilities such as landfills.

As such, there is a need for new materials that may be used in disposable absorbent products that generally retain their integrity and strength during use, but after such use, the materials may be more efficiently disposed of. For example, the disposable absorbent product may be easily and efficiently disposed of by composting. Alternatively, the disposable absorbent product may be easily and efficiently disposed of to a liquid sewage system wherein the disposable absorbent product is capable of being degraded by microorganisms.

Many of the commercially-available biodegradable polymers are aliphatic polyester materials. Although fibers prepared from aliphatic polyesters are known, problems have been encountered with their use. In particular, aliphatic polyester polymers are known to have a relatively slow crystallization rate as compared to, for example, polyolefin polymers, thereby often resulting in poor processability of the aliphatic polyester polymers. Most aliphatic polyester polymers also have much lower melting temperatures than polyolefins and are difficult to cool sufficiently following thermal processing. Aliphatic polyester polymers are, in general, not inherently wettable materials and may need modifications for use in a personal care application. In addition, the use of processing additives may retard the biodegradation rate of the original material or the processing additives themselves may not be biodegradable.

Also, while degradable monocomponent fibers are known, problems have been encountered with their use. In particular, known degradable fibers typically do not have good thermal dimensional stability if a heat-setting process is not employed in the process such that the fibers usually undergo severe heat-shrinkage due to the polymer chain relaxation during downstream heat treatment processes such as thermal bonding or lamination. The actual heat-setting process makes the non-woven process an impracticable method to spin fibers made from this polymer.

For example, although fibers prepared from poly(lactic acid) polymer are known, problems have been encountered with their use. In particular, poly(lactic acid) polymers are known to have a relatively slow crystallization rate as compared to, for example, polyolefin polymers, thereby often resulting in poor processability of the aliphatic polyester polymers. In addition, the poly(lactic acid) polymers generally do not have good thermal dimensional-stability. The poly(lactic acid) polymers usually undergo severe heat-shrinkage due to the relaxation of the polymer chain during downstream heat treatment processes, such as thermal bonding and lamination, unless an extra step such as heat setting is taken. However, such a heat setting step generally limits the use of the fiber in in-situ nonwoven forming processes, such as spunbond and meltblown, where heat setting is very difficult to be accomplished.

Additionally, when producing nonwovens for personal care applications, there are a number of physical properties that will enhance the functionality of the final web. To produce a web comprised of cut fibers, such as an airlaid or bonded carded web, one of the fibrous components must be a binder fiber. To effectively act as a binder fiber, the fibers are usually selected to be homogeneous multicomponent fibers with a significant difference, i.e. at least 20° C., in melt temperature between the higher-melting and the lower-melting components. These fibers may be formed in many different configurations, such as side-by-side or sheath core.

The majority of materials used in personal care applications are polyolefins, which are inherently hydrophobic materials. To make these materials functional, additional post-spinning treatment steps are required, such as surfactant treatment. These extra steps add cost and form a solution which is often not sufficient to achieve optimal fluid management properties.

For personal care applications, one of the most essential properties of nonwoven webs, and their component fibers, are the wetting characteristics. It is beneficial to produce a material that is hydrophilic and permanently wettable. One of the difficulties associated with the current staple fibers is the lack of permanent wettability. Polyolefins are hydrophobic materials which must undergo surfactant treatments to provide wettability. In addition to being only weakly hydrophilic after this treatment, this wettability is not permanent, since the surfactant tends to wash off during consecutive insults.

Accordingly, there is a need for a binder fiber which provides inherent wettability and binding properties. Additionally there is a need for a binder fiber that is biodegradable while also providing these improved wettability and binding properties and yet may be spun without significant heat shrinkage.

SUMMARY OF THE INVENTION

The present invention provides a binder fiber that is biodegradable while also providing improved wettability and binding properties and yet which is easily prepared and readily processable into selected final nonwoven structures without undergoing significant heat shrinkage typically encountered with the traditional polylactide or aliphatic polyester in post-thermal treatment processes.

One aspect of the present invention concerns a bicomponent binder fiber comprising an aliphatic polyester material in a side-by-side configuration with a polylactide polymer.

One embodiment of such a aliphatic polyester material comprises a mixture of an aliphatic polyester polymer selected from a polybutylene succinate polymer, a polybutylene succinate-co-adipate polymer, a polycaprolactone polymer, a mixture of such polymers, and a copolymer of such polymers; and a multicarboxylic acid, wherein the multicarboxylic acid has a total of carbon atoms that is less than about 30.

In another aspect, the present invention concerns a nonwoven structure including the bicomponent binder fiber disclosed herein.

One embodiment of such a nonwoven structure is a layer useful in a disposable absorbent product.

In another aspect, the present invention concerns a process for preparing the bicomponent binder fiber disclosed herein.

In another aspect, the present invention concerns a disposable absorbent product including the bicomponent binder fiber disclosed herein.

DETAILED DESCRIPTION OF THE INVENTION

The present invention is directed to a biodegradable binder fiber which comprises an aliphatic polyester material in a side-by-side configuration with a polylactide polymer. The aliphatic polyester material is a thermoplastic composition. As used herein, the term "thermoplastic" is meant to refer to a material that softens when exposed to heat and substantially returns to its original condition when cooled to room temperature.

Unmodified polylactide may undergo heat shrinkage of greater than 30 percent due to its slower crystallization rate during fiber processing. To reduce heat-shrinkage requires a later heat-setting stage. However, a heat-setting stage is not practical in a non-woven formation process. This makes the use of polylactide in a nonwovens process an unattractive option as any of the thermal finishing steps will render the fibers into small, hard, unrecognizable pieces. As polylactide is an otherwise feasible choice for a biodegradable polymer, it was desired to find a technique for overcoming this problem without sacrificing the biodegradability of the bicomponent fiber.

Aliphatic polyester polymers are biodegradable polymers that have other processing challenges associated with their use. Due to the very high viscosity and low melting temperatures of these polymers, it may be difficult to achieve sufficient cooling during fiber spinning. This leads to difficulties such as fiber aggregation during air drawing. The characteristics of these fibers result in very narrow operating windows for high-speed drawing processes.

By co-spinning this polymer with polylactide, this fiber aggregation may be reduced. In addition, because aliphatic polyester polymers have excellent thermal dimensional stability, it may act as a support for the polylactide, thereby substantially reducing heat shrinkage. This unique combination of materials in a side-by-side bicomponent configuration eliminates the processing and functional difficulties associated with each of the individual polymers. Finally, the aliphatic polyester polymer may be used to help cause nucleation of the polylactide, thereby facilitating crystallization of the polylactide.

To achieve optimal processing in a bicomponent system, it is beneficial that the polymers have compatible rheology characteristics. To tailor the properties of the polymer melt flow, a multicarboxylic acid may be added to the aliphatic polyester polymer, the polylactide polymer or both. This addition may be used to achieve not only processability, but also may impart functional attributes, such as self-crimping properties to the fibers.

It has been discovered that, by using an unreacted mixture of the components described herein, a binder fiber may be prepared wherein such binder fiber is substantially biodegradable yet which binder fiber is easily processed into nonwoven structures that exhibit beneficial fibrous mechanical properties.

The binder fiber, in one embodiment, comprises a bicomponent fiber comprising an aliphatic polyester material in a side-by-side configuration with a polylactide polymer. A multicarboxylic acid may be added to the aliphatic polyester polymer, the polylactide polymer or both.

The first component in the bicomponent fiber is an aliphatic polyester polymer selected from a polybutylene succinate polymer, a polybutylene succinate-co-adipate polymer, a polycaprolactone polymer, a mixture of such polymers, and a copolymer of such polymers.

A polybutylene succinate polymer is generally prepared by the condensation polymerization of a glycol and a dicarboxylic acid or an acid anhydride thereof. A polybutylene succinate polymer may either be a linear polymer or a long-chain branched polymer. A long-chain branched polybutylene succinate polymer is generally prepared by using an additional polyfunctional component selected from the group consisting of trifunctional or tetrafunctional polyols, oxycarboxylic acids, and polybasic carboxylic acids. Polybutylene succinate polymers are known in the art and are described, for example, in European Patent Application 0 569 153 A2 to Showa Highpolymer Co., Ltd., Tokyo, Japan.

A polybutylene succinate-co-adipate polymer is generally prepared by the polymerization of at least one alkyl glycol and more than one aliphatic multifunctional acid. Polybutylene succinate-co-adipate polymers are also known in the art.

Examples of polybutylene succinate polymers and polybutylene succinate-co-adipate polymers that are suitable for use in the present invention include a variety of polybutylene succinate polymers and polybutylene succinate-co-adipate polymers that arc available from Showa Highpolymer Co., Ltd., Tokyo, Japan, under the designation BIONOLLE™ 1020 polybutylene succinate polymer or BIONOLLE™ 3020 polybutylene succinate-co-adipate polymer, which are essentially linear polymers. These materials are known to be substantially biodegradable.

A polycaprolactone polymer is generally prepared by the polymerization of ε-caprolactone. Examples of polycaprolactone polymers that are suitable for use in the present invention include a variety of polycaprolactone polymers that are available from Union Carbide Corporation, Somerset, N.J., under the designation TONE™ Polymer P767E and TONE™ Polymer P787 polycaprolactone polymers. These materials are known to be substantially biodegradable.

In one embodiment, the aliphatic polyester polymer is selected from a polybutylene succinate polymer, a polybutylene succinate-co-adipate polymer, a polycaprolactone polymer, a mixture of such polymers, and a copolymer of such polymers. The aliphatic polyester polymer is present in the aliphatic polyester material in an amount effective to result in the binder fibers exhibiting selected properties. Beneficial properties may include, but are not limited to, reduced heat shrinkage and facilitation of crystallization of the polylactide polymer.

The aliphatic polyester polymer will be present in a weight amount that is greater than 0 but less than 100 weight percent. Beneficially, the weight ratio of the aliphatic polyester polymer to the polylactide polymer will range from about 1 to 1 to about 10 to 1. In another embodiment, the weight ratio of the aliphatic polyester polymer to the polylactide polymer will range from about 1.5 to 1 to about 9 to 1. In yet another embodiment, the weight ratio of the aliphatic polyester polymer to the polylactide polymer will range from about 2 to 1 to about 8 to 1. In still another embodiment, the weight ratio of the aliphatic polyester polymer to the polylactide polymer will range from about 3 to 1 to about 7 to 1. In yet another embodiment, the weight ratio of the aliphatic polyester polymer to the polylactide polymer will range from about 4 to 1 to about 6 to 1.

In one embodiment, the aliphatic polyester polymer exhibits a weight average molecular weight that is effective for the aliphatic polyester material to exhibit beneficial melt strength, fiber mechanical strength, and fiber spinning properties. In general, if the weight average molecular weight of an aliphatic polyester polymer is too high, this represents that the polymer chains are heavily entangled which may result in a thermoplastic composition comprising that aliphatic polyester polymer being difficult to process. Conversely, if the weight average molecular weight of an aliphatic polyester polymer is too low, this represents that the polymer chains are not entangled enough which may result in a aliphatic polyester material comprising that aliphatic polyester polymer exhibiting a relatively weak melt strength, making high speed processing very difficult. Thus, aliphatic polyester polymers suitable for use in the present invention exhibit weight average molecular weights that are beneficially between about 10,000 to about 2,000,000, more beneficially between about 50,000 to about 400,000, and suitably between about 100,000 to about 300,000. The weight average molecular weight for polymers or polymer blends may be determined by methods known to those skilled in the art.

In another embodiment, the aliphatic polyester polymer exhibits a polydispersity index value that is effective for the aliphatic polyester to exhibit beneficial melt strength, fiber mechanical strength, and fiber spinning properties. As used herein, "polydispersity index" is meant to represent the value obtained by dividing the weight average molecular weight of a polymer by the number average molecular weight of the polymer. The number average molecular weight for polymers or polymer blends may be determined by methods known to those skilled in the art. In general, if the polydispersity index value of an aliphatic polyester polymer is too high, a aliphatic polyester material comprising that aliphatic polyester polymer may be difficult to process due to inconsistent processing properties caused by polymer segments comprising low molecular weight polymers that have lower melt strength properties during spinning. Thus, in one embodiment, the aliphatic polyester polymer exhibits a polydispersity index value that is beneficially between about 1 to about 15, more beneficially between about 1 to about 4, and suitably between about 1 to about 3.

In another embodiment, the aliphatic polyester polymer is melt processable. In this embodiment the aliphatic polyester polymer exhibits a melt flow rate that is beneficially between about 1 gram per 10 minutes to about 200 grams per 10 minutes, suitably between about 10 grams per 10 minutes to about 100 grams per 10 minutes, and more suitably between about 20 grams per 10 minutes to about 40 grams per 10 minutes. The melt flow rate of a material may be determined, for example, according to ASTM Test Method D1238-E, incorporated in its entirety herein by reference.

In the present invention, the aliphatic polyester polymer is substantially biodegradable. As a result, the nonwoven material comprising the binder fiber will be substantially degradable when disposed of to the environment and exposed to air and/or water. As used herein, "biodegradable" is meant to represent that a material degrades from the action of naturally occurring microorganisms such as bacteria, fungi, and algae. The biodegradability of a material may be determined using ASTM Test Method 5338.92 or ISO CD Test Method 14855, each incorporated in their entirety herein by reference. In one particular embodiment, the biodegradability of a material may be determined using a modified ASTM Test Method 5338.92, wherein the test chambers are maintained at a constant temperature of about 58° C. throughout the testing rather than using an incremental temperature profile.

In the present invention, the aliphatic polyester polymer may be substantially compostable. As a result, the nonwoven material comprising binder fiber having the aliphatic polyester polymer will be substantially compostable when disposed of to the environment and exposed to air and/or water. As used herein, "compostable" is meant to represent that a material is capable of undergoing biological decomposition in a compost site such that the material is not visually distinguishable and breaks down into carbon dioxide, water, inorganic compounds, and biomass, at a rate consistent with known compostable materials.

The second part of the bicomponent binder fibers of the present invention comprises a polylactide polymer material. This polylactide polymer material should be a biodegradable material. Materials useful in the present invention include, but are not limited to, polylactide or poly(lactic acid) ("PLA") having different L:D ratios. PLA exists in two different optically active forms, the L and D isomers. A polylactide consisting of 100% L-PLA has a melting temperature around 175° C. By adjusting the L:D ratio, the melting temperature may be decreased. Accordingly, the PLA can have a blend of from 0 to 100% L isomer and from 100 to 0% D isomer.

The use of the aliphatic polyester polymer in a side-by-side conjunction with the polylactide polymer helps produce a bicomponent fiber that is degradable while also having improved thermal-dimensional stability. In general, many polylactide polymers undergo severe heat shrinkage upon thermal finishing steps, which prevents these materials from being used in nonwovens that include thermal processing steps, such as thermal bonding steps. However, the aliphatic polyester polymer facilitates the crystallization of the polylactide polymer as it is cooled. In the present invention, since the aliphatic polyester polymer is in a side-by-side configuration with the polylactide polymer, the aliphatic polyester polymer that contacts the polylactide is able to cause nucleation of the polylactide, thereby facilitating crystallization of the polylactide. As nucleation and crystallization occur at the interface during the molten stage, and the polylactide crystallizes, the nucleation sites propagate further into the remaining polylactide away from the interface. As such, the crystallization of the polylactide occurs more quickly during cooling of the fiber, resulting in lower heat shrinkage in the finished fiber. In one embodiment, the bicomponent fibers of the present invention have a heat shrinkage of less than about 15%. In another embodiment, the bicomponent fibers of the present invention have a heat shrinkage of less than about 10%. In yet another embodiment, the bicomponent fibers of the present invention have a heat shrinkage of less than about 5%.

The aliphatic polyester polymer also provides the benefit of providing good thermal stability and low melting temperatures and, as such, these aliphatic polyester polymers prevent heat shrinkage by holding the polylactide polymer in place during the solid state of the fiber. Because of the lower melting nature of the aliphatic polyester polymer, the bicomponent fibers may be used for any thermal binding steps.

The optional component in the bicomponent fibers of the present invention is a multicarboxylic acid. The multicarboxylic acid may be used with the aliphatic polyester polymer, the polylactide polymer, or both. The multicarboxylic acid permits the viscosity of the aliphatic polyester polymer, the polylactide polymer, or both to be tailored to achieve beneficial processing characteristics of the fibers.

A multicarboxylic acid is any acid that comprises two or more carboxylic acid groups. In one embodiment of the present invention, it is preferred that the multicarboxylic acid be linear. Suitable for use in the present invention are dicarboxylic acids, which comprise two carboxylic acid groups. In another embodiment, the multicarboxylic acid may have a total number of carbons that is not too large because then the crystallization kinetics, the speed at which crystallization occurs of a fiber or nonwoven structure prepared from the aliphatic polyester material, could be slower than is beneficial. It is therefore beneficial that the multicarboxylic acid have a total of carbon atoms that is beneficially less than about 30, more beneficially between about 4 to about 30, suitably between about 5 to about 20, and more suitably between about 6 to about 10. Suitable multicarboxylic acids include, but are not limited to, succinic acid, glutaric acid, adipic acid, pimelic acid, suberic acid, azelaic acid, sebacic acid, and mixtures of such acids. In one embodiment, the multicarboxylic acid is present in the aliphatic polyester polymer and/or the polylactide polymer in an amount effective to result in the thermoplastic composition exhibiting selected properties. The multicarboxylic acid may be present in the aliphatic polyester polymer and/or the polylactide polymer in a weight amount that is greater than 0 weight percent, beneficially between about 1 weight percent to about 15 weight percent, more beneficially between about 1 weight percent to about 10 weight percent, and most suitably between about 2 weight percent to about 5 weight percent, wherein all weight percents are based on the total weight amount of the aliphatic polyester polymer, the polylactide polymer, and the multicarboxylic acid present in the bicomponent fiber. This is substantially reduced from the amount of multicarboxylic acid that may be used in prior art applications.

The process of cooling an extruded polymer to ambient temperature is usually achieved by blowing ambient or sub-ambient temperature air over the extruded polymer. Such a process may be referred to as quenching or supercooling because the change in temperature is usually greater than 100° C. and most often greater than 150° C. over a relatively short time frame (seconds). By reducing the melt viscosity of a polymer, such polymer may generally be extruded successfully at lower temperatures. This will generally reduce the temperature change needed upon cooling, to preferably be less than 150° C. and, in some cases, less than 100° C. To customize this common process further into the ideal cooling temperature profile needed to be the sole method of maximizing the crystallization kinetics of aliphatic polyesters in a real manufacturing process is very difficult because of the extreme cooling needed within a very short period of time. Standard cooling methods may be used in combination with a second method of modification, though. The traditional second method is to have a nucleating agent, such as solid particulates, mixed with a thermoplastic composition to provide sites for initiating crystallization during quenching. However, such solid nucleating agents generally agglomerate very easily in the thermoplastic composition which may result in the blocking of filters and spinneret holes during spinning. In addition, the nucleating affect of such solid nucleating agents usually peaks at add-on levels of about 1 percent of such solid nucleating agents. Both of these factors generally reduce the ability or the desire to add in high weight percentages of such solid nucleating agents into the thermoplastic composition. In the processing of the aliphatic polyester polymer and/or the polylactide polymer, however, it has been found that the aliphatic polyester polymer functions as a nucleating agent for the polylactide polymer.

Another major difficulty encountered in the thermal processing of aliphatic polyester polymers into binder fibers is the sticky nature of these polymers. Attempts to draw the fibers, either mechanically, or through an air drawing process, will often result in the aggregation of the fibers into a solid mass. It is generally known that the addition of a solid filler will in most cases act to reduce the tackiness of a polymer melt. However, the use of a solid filler may be problematic in a nonwoven application were a polymer is extruded through a hole with a very small diameter. This is because the filler particles tend to clog spinneret holes and filter screens, thereby interrupting the fiber spinning process. In the present invention, in contrast, the multicarboxylic acid generally remains a liquid during the extrusion process, but then solidifies almost immediately during the quench process. Thus, the multicarboxylic acid effectively acts as a solid filler, enhancing the overall crystallinity of the system and acts as a viscosity modifier to reduce the tackiness of the fibers and eliminating problems such as fiber aggregation during drawing.

One of the advantages of the present invention is that the bicomponent fibers may be spun without the need of a wetting agent as part of the aliphatic polyester material. The wetting agent is not needed since the bicomponent fibers of the present invention are on the border between hydrophilic and hydrophobic. Additionally, the bicomponent fibers of the present invention have advancing contact angles close to about 90 degrees, which is an improvement over prior art bicomponent fibers that do utilize wetting agents.

Other additional attributes may be achieved through the present invention. Under certain process parameters and with certain compositions, fibers with self-crimping properties may be produced. That is, fibers that spontaneously crimp upon mechanical or air drawing to produce a crimp level, in one embodiment, of from 1 to about 20 crimps per inch. In another embodiment, the crimp level is from about 10 to about 20 crimps per inch.

While the principal components of the aliphatic polyester material used in the present invention have been described in the foregoing, such aliphatic polyester material is not limited thereto and may include other components not adversely effecting the selected properties of the aliphatic polyester material. Exemplary materials which could be used as additional components would include, without limitation, pigments, antioxidants, stabilizers, surfactants, waxes, flow promoters, solid solvents, plasticizers, nucleating agents, particulates, and other materials added to enhance the processability of the thermoplastic composition. If such additional components are included in a aliphatic polyester material, then additional components may be used in an amount that is beneficially less than about 10 weight percent, more beneficially less than about 5 weight percent, and suitably less than about 1 weight percent, wherein all weight percents are based on the total weight amount of the aliphatic polyester polymer, the polylactide polymer, and the multicarboxylic acid present in the bicomponent fiber.

Typical conditions for thermally processing the various components include using a shear rate that is beneficially between about 100 seconds$^{-1}$ to about 50000 seconds$^{-1}$, more beneficially between about 500 seconds$^{-1}$ to about 5000 seconds$^{-1}$, suitably between about 1000 seconds$^{-1}$ to about 3000 seconds$^{-1}$, and most suitably at about 1000 seconds$^{-1}$. Typical conditions for thermally processing the components also include using a temperature that is beneficially between about 50° C. to about 500° C., more beneficially between about 75° C. to about 300° C., and suitably between about 100° C. to about 250° C.

Once the aliphatic polyester polymer and the polylactide polymer have been selected and formed, these materials may be formed into the binder fibers by co-spinning the two materials. After spinning the fibers, they may be drawn, cut and/or crimped to produce hydrophilic staple fibers. These fibers may then be used in a bonded carded web or airlaid process to form nonwoven materials, that are then used in disposable garments. The short-staple fibers would also permit the fibers to degrade by microorganisms after disposal. The production of bicomponent fibers is performed on a dual-extruder spinning system. Each component is fed to a single or twin-screw extruder, heated to a melt, and fed to a spinneret. The design of the spinneret determines the final shape of the fibers. The molten polymer that is extruded through the spinneret is cooled by ambient or sub-ambient air until it reaches a solid state. The solid fibers are then drawn by any available means, such as godet roll. From there, any standard method of cutting, crimping, drawing, or treating fibers may be used.

As used herein, the term "hydrophobic" refers to a material having a contact angle of water in air of at least 90 degrees. In contrast, as used herein, the term "hydrophilic" refers to a material having a contact angle of water in air of less than 90 degrees. However, commercial personal care products generally require contact angles that are significantly below 90 degrees to provide selected liquid transport properties. To achieve the rapid intake and wetting properties beneficial for personal care products, the contact angle of water in air may be selected to fall below about 70 degrees. In general, the lower the contact angle, the better the wettability. For the purposes of this application, contact angle measurements are determined as set forth in the Test Methods section herein. The general subject of contact angles and the measurement thereof is well known in the art as, for example, in Robert J. Good and Robert J. Stromberg, Ed., in "Surface and Colloid Science—Experimental Methods", Vol. II, (Plenum Press, 1979). As set forth, the advancing contact angles are about 90 degrees.

It is generally beneficial that the melting or softening temperature of the aliphatic polyester material be within a range that is typically encountered in most process applications. As such, it is generally selected that the melting or softening temperature of the aliphatic polyester material beneficially be between about 25° C. to about 350° C., more beneficially be between about 35° C. to about 300° C., and suitably be between about 45° C. to about 250° C.

An aliphatic polyester blended with a multicarboxylic acid used in the present invention has been found to generally exhibit improved processability properties as compared to a thermoplastic composition comprising the aliphatic polyester polymer but none of the multicarboxylic acid. This is generally due to the significant reduction in viscosity that occurs due to the multicarboxylic acid. Without the multicarboxylic acid, the viscosity of the aliphatic polyester polymer may be too high to process.

As used herein, the improved processability of a aliphatic polyester material is measured as a decline in the apparent viscosity of the thermoplastic composition at a temperature of about 170° C. and a shear rate of about 1000 seconds$^{-1}$, typical industrial extrusion processing conditions. If the aliphatic polyester material exhibits an apparent viscosity that is too high, the aliphatic polyester material will generally be very difficult to process. In contrast, if the aliphatic polyester material exhibits an apparent viscosity that is too low, the aliphatic polyester material will generally result in an extruded fiber that has very poor tensile strength.

Therefore, it is generally beneficial that the aliphatic polyester material exhibits an Apparent Viscosity value at a temperature of about 170° C. and a shear rate of about 1000 seconds$^{-1}$ that is beneficially between about 5 Pascal seconds (Pa·s) to about 200 Pascal seconds, more beneficially between about 10 Pascal seconds to about 150 Pascal seconds, and suitably between about 20 Pascal seconds to about 100 Pascal seconds. The method by which the Apparent Viscosity value is determined is set forth below in connection with the examples.

As used herein, the term "fiber" or "fibrous" is meant to refer to a material wherein the length to diameter ratio of such material is greater than about 10. Conversely, a "nonfiber" or "nonfibrous" material is meant to refer to a material wherein the length to diameter ratio of such material is about 10 or less.

Methods for making fibers are well known and need not be described here in detail. The melt spinning of polymers includes the production of continuous filament, such as spunbond or meltblown, and non-continuous filament, such as staple and short-cut fibers, structures. To form a spunbond or meltblown fiber, generally, a thermoplastic composition is extruded and fed to a distribution system where the thermoplastic composition is introduced into a spinneret plate. The spun fiber is then cooled, solidified, drawn by an aerodynamic system and then formed into a conventional nonwoven. Meanwhile, to produce short-cut or staple the spun fiber is cooled, solidified, and drawn, generally by a mechanical rolls system, to an intermediate filament diameter and collected fiber, rather than being directly formed into a nonwoven structure. Subsequently, the collected fiber may be "cold drawn" at a temperature below its softening temperature, to the selected finished fiber diameter and may be followed by crimping/texturizing and cutting to a selected fiber length. Multicomponent fibers may be cut into relatively short lengths, such as staple fibers which generally have lengths in the range of about 25 to about 50 millimeters and short-cut fibers which are even shorter and generally have lengths less than about 18 millimeters. See, for example, U.S. Pat. No. 4,789,592 to Taniguchi et al, and U.S. Pat. No. 5,336,552 to Strack et al., both of which are incorporated herein by reference in their entirety.

The biodegradable nonwoven materials using the binder fibers of the present invention are suited for use in disposable products including disposable absorbent products such as diapers, adult incontinent products, and bed pads; in catamenial devices such as sanitary napkins, and tampons; and other absorbent products such as wipes, bibs, wound dressings, and surgical capes or drapes. Accordingly, in another aspect, the present invention relates to a disposable absorbent product comprising the multicomponent fibers.

In one embodiment of the present invention, the binder fibers are formed into a fibrous matrix for incorporation into a disposable absorbent product. A fibrous matrix may take the form of, for example, a fibrous nonwoven web. The length of the fibers used may depend on the particular end use contemplated. Where the fibers are to be degraded in water as, for example, in a toilet, it is advantageous if the lengths are maintained at or below about 15 millimeters.

In one embodiment of the present invention, a disposable absorbent product is provided, which disposable absorbent product generally comprises a composite structure including a liquid-permeable topsheet, a fluid acquisition layer, an absorbent structure, and a liquid-impermeable backsheet, wherein at least one of the liquid-permeable topsheet, the fluid acquisition layer, or the liquid-impermeable backsheet comprises the nonwoven material of the present invention. In some instances, it may be beneficial for all three of the topsheet, the fluid acquisition layer, and the backsheet to comprise the nonwoven materials described.

In another embodiment, the disposable absorbent product may comprise generally a composite structure including a liquid-permeable topsheet, an absorbent structure, and a liquid-impermeable backsheet, wherein at least one of the liquid-permeable topsheet or the liquid-impermeable backsheet comprises the nonwoven materials described.

In another embodiment of the present invention, the nonwoven material may be prepared on a spunbond line. Resin pellets comprising the thermoplastic materials previously described are formed and predried. Then, they are fed to a single extruder. The fibers may be drawn through a fiber draw unit (FDU) or air-drawing unit onto a forming wire and thermally bonded. However, other methods and preparation techniques may also be used.

Exemplary disposable absorbent products are generally described in U.S. Pat. No. 4,710,187; U.S. Pat. No. 4,762,521; U.S. Pat. No. 4,770,656; and U.S. Pat. No. 4,798,603; which references are incorporated herein by reference.

Absorbent products and structures according to all aspects of the present invention are generally subjected, during use, to multiple insults of a body liquid. Accordingly, the absorbent products and structures are capable of absorbing multiple insults of body liquids in quantities to which the absorbent products and structures will be exposed during use. The insults are generally separated from one another by a period of time.

Test Methods

Melting Temperature

The melting temperature of a material was determined using differential scanning calorimetry. A differential scanning calorimeter, under the designation Thermal Analyst 2910 Differential Scanning Calorimeter, which was outfitted with a liquid nitrogen cooling accessory and used in combination with Thermal Analyst 2200 analysis software (version 8.10) program, both available from T.A. Instruments Inc. of New Castle, Del., was used for the determination of melting temperatures.

The material samples tested were either in the form of fibers or resin pellets. It was preferred to not handle the material samples directly, but rather to use tweezers and other tools, so as not to introduce anything that would produce erroneous results. The material samples were cut, in the case of fibers, or placed, in the case of resin pellets, into an aluminum pan and weighed to an accuracy of 0.01 mg on an analytical balance. If needed, a lid was crimped over the material sample onto the pan.

The differential scanning calorimeter was calibrated using an indium metal standard and a baseline correction performed, as described in the manual for the differential scanning calorimeter. A material sample was placed into the test chamber of the differential scanning calorimeter for testing and an empty pan is used as a reference. All testing was run with a 55 cubic centimeter/minute nitrogen (industrial grade) purge on the test chamber. The heating and cooling program was a 2 cycle test that begins with equilibration of the chamber to −75° C., followed by a heating cycle of 20° C./minute to 220° C., followed by a cooling cycle at 20° C./minute to −75° C., and then another heating cycle of 20° C./minute to 220° C.

The results were evaluated using the analysis software program wherein the glass transition temperature (Tg) of inflection, endothermic and exothermic peaks were identified and quantified. The glass transition temperature was identified as the area on the line where a distinct change in slope occurs and then the melting temperature is determined using an automatic inflection calculation.

Apparent Viscosity

A capillary rheometer, under the designation Göttfert Rheograph 2003 capillary rheometer, which was used in combination with WinRHEO (version 2.31) analysis software, both available from Göttfert Company of Rock Hill, S.C., was used to evaluate the apparent viscosity rheological properties of material samples. The capillary rheometer setup included a 2000 bar pressure transducer and a 30 mm length/30 mm active length/1 mm diameter/0 mm height/180° run in angle, round hole capillary die.

If the material sample being tested demonstrated or was known to have water sensitivity, the material sample was dried in a vacuum oven above its glass transition temperature, i.e. above 55 or 60° C. for poly(lactic acid) materials, under a vacuum of at least 15 inches of mercury with a nitrogen gas purge of at least 30 standard cubic feet per hour for at least 16 hours.

Once the instrument was warmed up and the pressure transducer was calibrated, the material sample was loaded incrementally into the column, packing resin into the column with a ramrod each time to ensure a consistent melt during testing. After material sample loading, a 2 minute melt time preceded each test to allow the material sample to completely melt at the test temperature. The capillary rheometer took data points automatically and determined the apparent viscosity (in Pascal second) at 7 apparent shear rates (in second$^{-1}$): 50, 100, 200, 500, 1000, 2000, and 5000. When examining the resultant curve it was important that the curve be relatively smooth. If there were significant deviations from a general curve from one point to another, possibly due to air in the column, the test run was repeated to confirm the results.

The resultant rheology curve of apparent shear rate versus apparent viscosity gives an indication of how the material sample will run at that temperature in an extrusion process. The apparent viscosity values at a shear rate of at least 1000 seconds$^{-1}$ are of specific interest because these are the typical conditions found in commercial fiber spinning extruders.

Contact Angle

The equipment includes a DCA-322 Dynamic Contact Angle Analyzer and WinDCA (version 1.02) software, both available from ATI-CAHN Instruments, Inc., of Madison, Wis. Testing was done on the "A" loop with a balance stirrup attached. Calibrations should be done monthly on the motor and daily on the balance (100 mg mass used) as indicated in the manual.

Thermoplastic compositions were spun into fibers and the freefall sample (jetstretch of 0) was used for the determination of contact angle. Care should be taken throughout fiber preparation to minimize fiber exposure to handling to ensure that contamination is kept to a minimum. The fiber sample was attached to the wire hanger with scotch tape such that 2–3 cm of fiber extended beyond the end of the hanger. Then the fiber sample was cut with a razor so that approximately 1.5 cm was extending beyond the end of the hanger. An optical microscope was used to determine the average diameter (3 to 4 measurements) along the fiber.

The sample on the wire hanger was suspended from the balance stirrup on loop "A". The immersion liquid was distilled water and it was changed for each specimen. The specimen parameters were entered (i.e. fiber diameter) and the test started. The stage advanced at 151.75 microns/second until it detected the Zero Depth of Immersion when the fiber contacted the surface of the distilled water. From the Zero Depth of Immersion, the fiber advanced into the water for 1 cm, dwelled for 0 seconds and then immediately receded 1 cm. The auto-analysis of the contact angle done by the software determined the advancing and receding contact angles of the fiber sample based on standard calculations identified in the manual. Contact angles of zero or less than zero indicate that the sample had become totally wettable. Five replicates for each sample were tested and a statistical analysis for mean, standard deviation, and coefficient of variation percent was calculated. As reported in the examples herein and as used throughout the claims, the Advancing Contact Angle value represents the advancing contact angle of distilled water on a fiber sample determined according to the preceding test method. Similarly, as reported in the examples herein and as used throughout the claims, the Receding Contact Angle value represents the receding contact angle of distilled water on a fiber sample determined according to the preceding test method.

Heat Shrinkage Testing

A sample of approximately 20 filaments produced at a drawdown speed of 400 meters per minute or higher is gathered into a bundle and taped at one end. The fiber bundles are then clipped to one edge of a piece of graph paper that is supported by a poster board. The other end of the bundle is pulled taught and lined up parallel to the vertical lines on the graph paper. Next, at seven inches down from where the clip is binding the fiber, pinch a 0.5 g sinker around the fiber bundle. Usually, three replicates may be attached at one time. Marks may be made on the graph paper to indicate the initial positions of the sinkers. The samples are placed into a 105° C. oven such that they hang vertically and do not touch the poster board. Every 5 minutes until 30 minutes have elapsed, the position of the sinkers is quickly measured without removing the samples from the oven. The change in the fiber bundle length is then used to calculate a percentage decrease in length, referred to in the present application as percent heat shrinkage.

EXAMPLES

Various materials were used as components to form thermoplastic compositions and multicomponent fibers in the following Examples. The designation and various properties of these materials are listed in Table 1.

A poly(lactic acid) (PLA) polymer was obtained from Chronopol Inc., Golden, Colo. under the designation HEPLON™ E10001 poly(lactic acid) polymer.

A polybutylene succinate polymer, available from Showa Highpolymer Co., Ltd., Tokyo, Japan, under the designation BIONOLLE™ 1020 polybutylene succinate, was obtained.

A polybutylene succinate-co-adipate, available from Showa Highpolymer Co., Ltd., Tokyo, Japan, under the designation BIONOLLE™ 3020 polybutylene succinate-coadipate, was obtained.

Adipic acid was used as a multicarboxylic acid.

Examples 1–10

The materials were pre-dried overnight in a vacuum oven above the glass transition temperature of the polymers. Due to the fact that polylactide is hygroscopic and its processing characteristics deteriorate rapidly with increased moisture content, the intensity of this drying was varied as necessary, depending on the history of the material and anticipated level of exposure to atmospheric moisture. Care was taken since ambient humidity may have a significant impact on the processability of these materials.

The aliphatic polyester material was prepared by taking the various components, dry mixing them, followed by melt blending them in a counter-rotating twin screw extruder to provide vigorous mixing of the components. The melt mixing involves partial or complete melting of the components combined with the shearing effect of rotating mixing screws. Such conditions are conducive to optimal blending and even dispersion of the components of the thermoplastic composition. Twin screw extruders such as a Haake Rheocord 90 twin screw extruder, available from Haake GmbH of Karlsautte, Germany, or a Brabender twin screw mixer (cat no 05-96-000) available from Brabender Instruments of South Hackensack, N.J., or other comparable twin screw extruders, are well suited to this task. This also includes co-rotating twin screw extruders such as the ZSK-30 extruder, available from Werner and Pfleiderer Corporation of Ramsey, N.J. Unless otherwise indicated, all samples were prepared on a Haake Rheocord 90 twin screw extruder. The melted composition is cooled following extrusion from the melt mixer on either a liquid cooled roll or surface and/or by forced air passed over the extrudate. The cooled composition was then subsequently pelletized for conversion to fibers.

The conversion of these resins into the binder fibers was conducted on an in-house spinning line with two 0.75 inch (1.905 cm) diameter extruders. Each extruder has a 24:1 L:D (length:diameter) ratio screw and five heating zones which feed into a transfer pipe from the extruder to the spin pack. The transfer pipe constitutes the $4^{th}$ and $5^{th}$ heating zones and contains a 0.75 inch diameter KOCH™ SMX type static mixer unit, available from Koch Engineering Company Inc. of New York, N.Y. The transfer pipe extends into the spinning head ($6^{th}$ and $7^{th}$ heating zones) and through a spin plate with numerous small holes which the molten polymer is extruded through. The spin plate used herein had three metal plates that distributed the two polymers and had a fourth plate that aligns the flows to produce side-by-side bicomponent fibers. The fourth spin plate has 15–30 holes, where each hole has a 12 mil (0.305 mm) diameter. The fibers are air quenched using air at a temperature of 13° C. to 22° C. and drawn on a godet roll. If post-spinning stretch is desired, a second godet roll may be added at a slightly higher rotation rate and the fibers stretched between the two rolls.

The binder fibers of the present invention were produced on a lab-scale, in-house spinning line. The spinning line consisted of two 24:1 L:D, single screw extruders, static mixing units, and a spin pack. The spin pack contained three layered plates which distributed the polymer, followed by a fourth plate whose construction determined the configuration of the final fibers. For these examples a side-by-side configuration was used.

The processability of these bicomponent fibers was very good. This was due to the fact that the use of adipic acid allowed the tailorization of the viscosity of the polylactide polymer and the polybutylene succinate/polybutylene succinate co-adipate polymers to achieve the desired processing characteristics.

TABLE 1

Heat Shrinkage Data

| Sample | Component 1 | Component 2 | Ratio Component 1 to Component 2 | Processability | % Heat Shrinkage |
|---|---|---|---|---|---|
| 1 | Bionelle | Heplon E10001 | 1:1 | Good | 4% |
| 2 | Bionelle | Heplon E10001 | 1:2 | Good | 16% |
| 3 | Bionelle | Heplon E10001 | 2:1 | Good | 2% |
| 4 | Bionelle | Heplon E10001/ Adipic Acid (90:10) | 1:1 | Excellent | 1% |
| 5 | Bionelle | Heplon E10001/ Adipic Acid (90:10) | 1:2 | Great | 3% |
| 6 | Bionelle | Heplon E10001/ Adipic Acid (90:10) | 2:1 | Excellent | 1% |
| 7 | Bionelle | | 1:0 | Excellent | 0% |
| 8 | | Heplon E10001 Adipic Acid (90:10) | 0:1 | Good | 32% |
| 9 | | Heplon E10001/ Adipic Acid (90:10) | 0:1 | Good | 10% |
| 10 | | Heplon E10001/ Adipic Acid (70:30) | 0:1 | Good | 0% |

TABLE 2

Fiber Spinning Temperature Profile

| Sample | Heating Zone Temperatures for Component 1 Fiber (° C.) | Heating Zone Temperatures for Component 2 Fiber (° C.) |
|---|---|---|
| 1 | 150/150/155/160/160/160/160 | 155/155/160/160/160/160/160/160 |
| 2 | 150/150/155/160/160/160/160 | 155/155/160/160/160/160/160/160 |
| 3 | 150/150/155/160/160/160/160 | 155/155/160/160/160/160/160/160 |
| 4 | 160/165/165/170/170/155 | 160/165/165/170/170/155 |
| 5 | 160/165/165/170/170/155 | 160/165/165/170/170/155 |
| 6 | 160/165/165/170/170/155 | 160/165/165/170/170/155 |
| 7 | 150/150/155/160/160/160/160 | |
| 8 | | 155/155/160/160/160/160/160/160 |
| 9 | | 160/165/165/170/170/155 |
| 10 | | 150/170/165/165/165/166 |

Examples 11–12

These examples show the comparison of a Heplon/Bionelle fiber with a multicarboxylic acid and one with a multicarboxylic acid to show how the latter fiber is self-crimping.

TABLE 3

Crimp Level Data

| Composition | | Ratio | Crimp Level |
|---|---|---|---|
| Bionelle | Heplon E10001 | 1:1 | 0 |
| Bionelle | Heplon E10001/Adipic Acid 90:10 | 1:1 | 16 crimps/inch |

Those skilled in the art will recognize that the present invention is capable of many modifications and variations without departing from the scope thereof. Accordingly, the detailed description and examples set forth above are meant to be illustrative only and are not intended to limit, in any manner, the scope of the invention as set forth in the appended claims.

What is claimed is:

1. A bicomponent binder fiber comprising a first component containing a blend of an aliphatic polyester material and a multicarboxylic acid, and a second component of a polylactide polymer in a side-by-side configuration;

wherein the bicomponent binder fiber exhibits a heat shrinkage value that is less than about 15%;

further wherein the weight ratio of the aliphatic polyester polymer to the polylactide polymer will range from about 1 to 1 to about 10 to 1.

2. The bicomponent binder fiber of claim 1, wherein the bicomponent binder fiber exhibits a heat shrinkage value that is less than about 10%.

3. The bicomponent binder fiber of claim 1, wherein the bicomponent binder fiber exhibits a heat shrinkage value that is less than about 5%.

4. The bicomponent binder fiber of claim 1, wherein the aliphatic polyester polymer is selected from a polybutylene succinate polymer, a polybutylene succinate-co-adipate polymer, a polycaprolactone polymer, a mixture of such polymers, and a copolymer of such polymers.

5. The bicomponent binder fiber of claim 4, wherein the aliphatic polyester polymer is a polybutylene succinate polymer.

6. The bicomponent binder fiber of claim 4, wherein the aliphatic polyester polymer is a polybutylene succinate-co-adipate polymer.

7. The bicomponent binder fiber of claim 4, wherein the aliphatic polyester polymer is a polycaprolactone polymer.

8. The bicomponent binder fiber of claim 1, wherein the polylactide polymer is selected from polylactide or poly (lactic acid) having different L:D ratios.

9. The bicomponent binder fiber of claim 1, wherein the multicarboxylic acid is selected from succinic acid, glutaric acid, adipic acid, pimelic acid, suberic acid, azelaic acid, sebacic acid, and a mixture of such acids.

10. The bicomponent binder fiber of claim 1, wherein the multicarboxylic acid is present in the aliphatic polyester polymer in a weight amount that is between about 0.1 weight percent to about 10 weight percent.

11. The bicomponent binder fiber of claim 10, wherein the multicarboxylic acid is present in the aliphatic polyester polymer in a weight amount that is between about 0.1 weight percent to about 5 weight percent.

12. The bicomponent binder fiber of claim 11, wherein the multicarboxylic acid is present in the aliphatic polyester polymer in a weight amount that is between about 0.1 weight percent to about 3 weight percent.

13. The bicomponent binder fiber of claim 1, further comprising a multicarboxylic acid mixed with the polylactide polymer.

14. The bicomponent binder fiber of claim 13, wherein the multicarboxylic acid is selected from succinic acid, glutaric acid, adipic acid, pimelic acid, suberic acid, azelaic acid, sebacic acid, and a mixture of such acids.

15. The bicomponent binder fiber of claim 13, wherein the multicarboxylic acid is present in the polylactide polymer in a weight amount that is between about 1 weight percent to about 15 weight percent.

16. The bicomponent binder fiber of claim 15, wherein the multicarboxylic acid is present in the polylactide polymer in a weight amount that is between about 1 weight percent to about 10 weight percent.

17. The bicomponent binder fiber of claim 16, wherein the multicarboxylic acid is present in the polylactide polymer in a weight amount that is between about 2 weight percent to about 5 weight percent.

18. The bicomponent binder fiber of claim 1, further comprising a multicarboxylic acid mixed with the aliphatic polyester polymer and with the polylactide polymer.

19. The bicomponent binder fiber of claim 18, wherein the multicarboxylic acid is selected from succinic acid, glutaric acid, adipic acid, pimelic acid, suberic acid, azelaic acid, sebacic acid, and a mixture of such acids.

20. The bicomponent binder fiber of claim 18, wherein the multicarboxylic acid is present in the aliphatic polyester polymer in a weight amount that is between about 0.1 weight percent to about 10 weight percent and wherein the multicarboxylic acid is present in the polylactide polymer in a weight amount that is between about 1 weight percent to about 15 weight percent.

21. The bicomponent binder fiber of claim 20, wherein the multicarboxylic acid is present in the aliphatic polyester polymer in a weight amount that is between about 0.1 weight percent to about 5 weight percent and wherein the multicarboxylic acid is present in the polylactide polymer in a weight amount that is between about 1 weight percent to about 10 weight percent.

22. The bicomponent binder fiber of claim 21, wherein the multicarboxylic acid is present in the aliphatic polyester polymer in a weight amount that is between about 0.1 weight percent to about 3 weight percent and wherein the multicarboxylic acid is present in the polylactide polymer in a weight amount that is between about 2 weight percent to about 5 weight percent.

23. The bicomponent binder fiber of claim 1, wherein the weight ratio of the aliphatic polyester polymer to the polylactide polymer will range from about 1.5 to 1 to about 9 to 1.

24. The bicomponent binder fiber of claim 23, wherein the weight ratio of the aliphatic polyester polymer to the polylactide polymer will range from about 2 to 1 to about 8 to 1.

25. The bicomponent binder fiber of claim 24, wherein the weight ratio of the aliphatic polyester polymer to the polylactide polymer will range from about 3 to 1 to about 7 to 1.

26. The bicomponent binder fiber of claim 25, wherein the weight ratio of the aliphatic polyester polymer to the polylactide polymer will range from about 4 to 1 to about 6 to 1.

* * * * *